US007041211B2

(12) United States Patent
Kalnes

(10) Patent No.: US 7,041,211 B2
(45) Date of Patent: May 9, 2006

(54) HYDROCRACKING PROCESS

(75) Inventor: Tom N. Kalnes, LaGrange, IL (US)

(73) Assignee: UOP LLC, Des Plaines, IL (US)

( * ) Notice: Subject to any disclaimer, the term of this patent is extended or adjusted under 35 U.S.C. 154(b) by 498 days.

(21) Appl. No.: 10/447,610

(22) Filed: May 29, 2003

(65) Prior Publication Data

US 2003/0196934 A1 Oct. 23, 2003

Related U.S. Application Data

(63) Continuation-in-part of application No. 09/894,416, filed on Jun. 28, 2001, now abandoned.

(51) Int. Cl.
*C10G 65/12* (2006.01)

(52) U.S. Cl. ..... 208/89; 208/88; 208/57; 208/58

(58) Field of Classification Search ..... 208/88, 208/89, 57, 58
See application file for complete search history.

(56) References Cited

U.S. PATENT DOCUMENTS 3,328,290 A 6/1967 Hengstebeck ..... 208/89
4,424,117 A * 1/1984 Kuno ..... 208/211
5,403,469 A 4/1995 Vauk et al. ..... 208/78
5,720,872 A 2/1998 Gupta ..... 208/57
5,976,354 A * 11/1999 Powers et al. ..... 208/89
5,980,729 A 11/1999 Kalnes et al. ..... 208/89
6,106,694 A 8/2000 Kalnes et al. ..... 208/57
6,217,749 B1 * 4/2001 Espeillac et al. ..... 208/213
6,635,170 B1 * 10/2003 Ravella ..... 208/210

* cited by examiner

*Primary Examiner*—Walter D. Griffin
(74) *Attorney, Agent, or Firm*—John G. Tolomei; James C. Paschall; John G. Cutts, Jr.

(57) ABSTRACT

A hydrocracking process wherein a hydrocarbonaceous feedstock and hydrogen is passed to a denitrification and desulfurization reaction zone and then directly to a hot, high pressure stripper utilizing a hot, hydrogen-rich stripping gas to produce a liquid hydrocarbonaceous stream which is passed to a hydrocracking zone. The resulting effluent from the hydrocracking zone is then directly passed to the hot, high pressure stripper. A vapor stream from the hot, high pressure stripper is passed to a post-treat hydrogenation reaction zone to saturate at least a portion of the aromatic compounds contained therein.

11 Claims, 1 Drawing Sheet

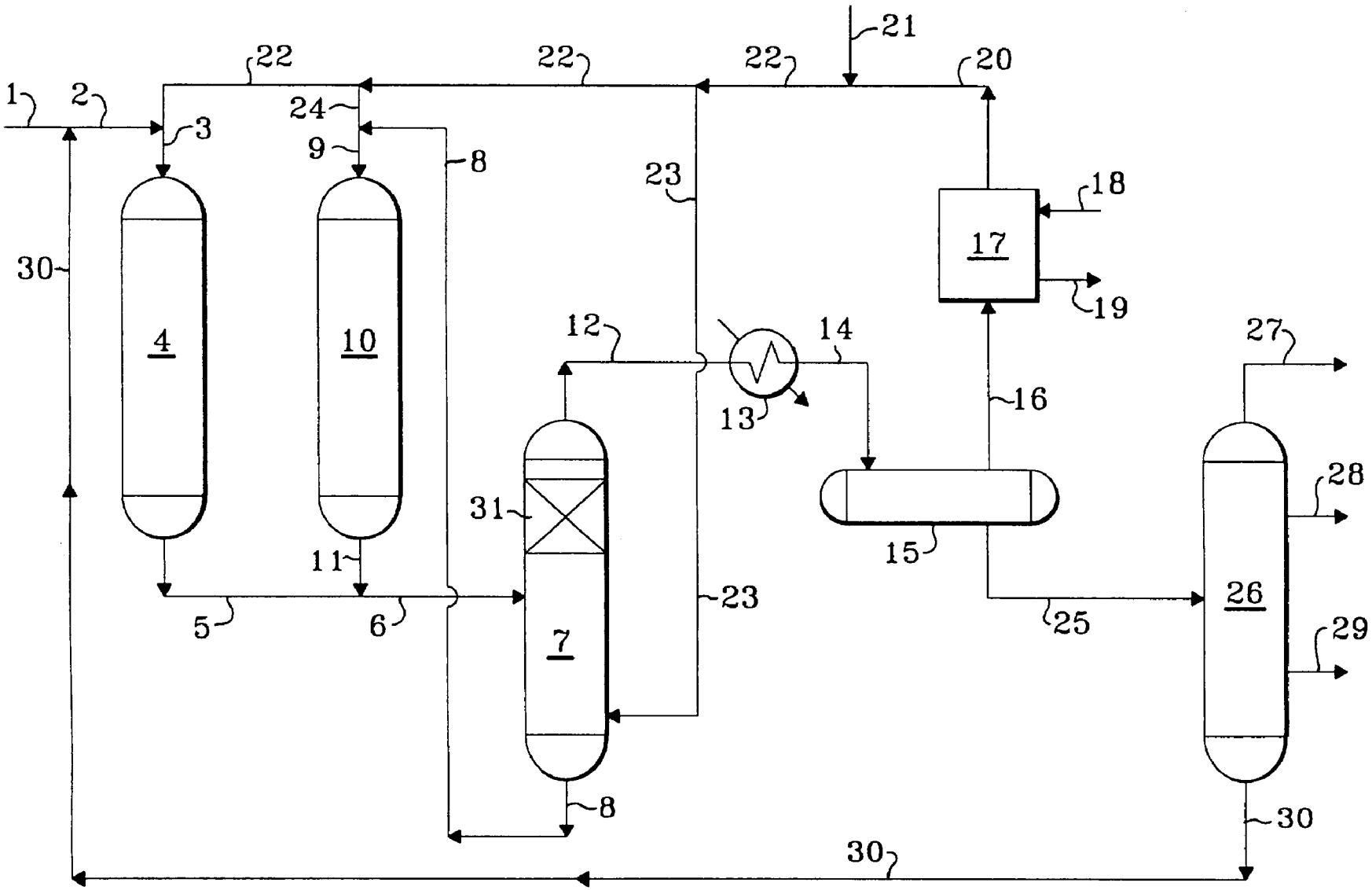
1
2
3
4
5
6
7
8
9
10
11
12
13
14
15
16
17
18
19
20
21
22
23
24
25
26
27
28
29
30
31

HYDROCRACKING PROCESS

CROSS-REFERENCE TO RELATED APPLICATION

The present application is a Continuation-in-Part of application Ser. No. 09/894,416, which was filed Jun. 28, 2001, now abandoned, the disclosure of which is incorporated by reference in its entirety herein.

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil or heavy fractions thereof, for example. Feedstocks most often subjected to hydrocracking are gas oils and heavy gas oils recovered from crude oil by distillation. A typical heavy gas oil comprises a substantial portion of hydrocarbon components boiling above about 371° C. (700° F.), usually at least about 50 percent by weight boiling above 371° C. (700° F.). A typical vacuum gas oil normally has a boiling point range between about 315° C. (600° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

Traditionally, the fresh feedstock for a hydrocracking process is first introduced into a denitrification and desulfurization zone particularly suited for the removal of sulfur and nitrogen contaminants and subsequently introduced into a hydrocracking zone containing hydrocracking catalyst. Another method of hydrocracking a fresh feedstock is to introduce the fresh feedstock and the effluent from the hydrocracking zone into the denitrification and desulfurization zone. The resulting effluent from the hydrocracking zone is separated to produce desired hydrocracked products and unconverted feedstock which is then introduced into the hydrocracking zone.

In the latter case, the diameter of the desulfurization and denitrification zone must be sufficiently large to accommodate not only the fresh feedstock but also the entire effluent from the hydrocracking zone. In world class hydrocracking units the diameter of the vessel utilized for the desulfurization and denitrification reaction zone becomes very large. Some of the largest vessels utilized in hydrocracking processes are 6.1 meters (20 feet) in diameter with wall thickness of 0.46 meters (1.5 feet) and weighing up to 2000 tons. At some point the required size of this vessel becomes larger than can be constructed by the existing manufacturing facilities, and the transport of very large vessels, because of their weight and girth, become impossible to transport via conventional methods. When this occurs the only alternative is to utilize an entire second train which not only needs a desulfurization and denitrification vessel but also another hydrocracking vessel. With the addition of a parallel train the equipment count and complexity of the hydrocracking plant become much greater.

Although a wide variety of process flow schemes, operating conditions and catalysts have been used in commercial activities, there is always a demand for new hydrocracking methods which provide lower costs, ease of construction, higher liquid product yields and higher quality products.

INFORMATION DISCLOSURE

U.S. Pat. No. 5,720,872 B1 discloses a process for hydroprocessing liquid feedstocks in two or more hydroprocessing stages which are in separate reaction vessels and wherein each reaction stage contains a bed of hydroprocessing catalyst. The liquid product from the first reaction stage is sent to a low pressure stripping stage and stripped of hydrogen sulfide, ammonia and other dissolved gases. The stripped product stream is then sent to the next downstream reaction stage, the product from which is also stripped of dissolved gases and sent to the next downstream reaction stage until the last reaction stage, the liquid product of which is stripped of dissolved gases and collected or passed on for further processing. The flow of treat gas is in a direction opposite the direction in which the reaction stages are staged for the flow of liquid. Each stripping stage is a separate stage, but all stages are contained in the same stripper vessel.

U.S. Pat. No. 3,328,290 B1 (Hengstebeck) discloses a two-stage process for the hydrocracking of hydrocarbons in which the feed is pretreated in the first stage.

U.S. Pat. No. 5,980,729 B1 (Kalnes et al) discloses a hydrocracking process wherein a hydrocarbonaceous feedstock and a hot hydrocracking zone effluent containing hydrogen is passed to a denitrification and desulfurization reaction zone to produce hydrogen sulfide and ammonia to thereby clean up the fresh feedstock. The resulting hot, uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydrocarbonaceous stream.

U.S. Pat. No. 5,403,469 B1 (Vauk et al) discloses a parallel hydrotreating and hydrocracking process. Effluent from the two processes are combined in the same separation vessel and separated into a vapor comprising hydrogen and a hydrocarbon-containing liquid. The hydrogen is shown to be supplied as part of the feed streams to both the hydrocracking and the hydrotreater.

U.S. Pat. No. 5,980,729 (Kalnes et al) discloses a hydrocracking process wherein a hydrocarbonaceous feedstock and a hot hydrocracking zone effluent containing hydrogen is passed to a denitrification and desulfurization reaction zone to produce hydrogen sulfide and ammonia to thereby clean up the fresh feedstock. The resulting hot, uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydrocarbonaceous stream containing unconverted feedstock. This liquid hydrocarbonaceous stream is introduced into a hydrocracking zone to produce a hydrocracking zone effluent which then joins the fresh feedstock as described hereinabove and is subsequently introduced into the denitrification and desulfurization zone. This patent does not disclose the introduction of the hydrocracking zone effluent directly into the hot, high pressure stripper.

U.S. Pat. No. 6,106,694 (Kalnes et al) discloses a hydrocracking process wherein a hydrocarbonaceous feedstock and a hot hydrocracking zone effluent is passed to a denitrification and desulfurization reaction zone to produce hydrogen sulfide and ammonia to thereby clean up the fresh feedstock. The resulting hot, uncooled effluent from the denitrification and desulfurization zone is hydrogen stripped in a stripping zone maintained at essentially the same pressure as the preceding reaction zone with a hydrogen-rich gaseous stream to produce a vapor stream comprising hydrogen, hydrocarbonaceous compounds boiling at a temperature below the boiling range of the fresh feedstock, hydrogen sulfide and ammonia, and a liquid hydrocarbonaceous stream containing unconverted feedstock. This liquid hydrocarbonaceous stream is subsequently introduced into the hydrocracking zone to produce an effluent which is subsequently introduced into the denitrification and desulfurization reaction zone as described hereinabove. In accordance with this patent the diameter of the desulfurization and denitrification reaction zone mush be sufficiently large to accommodate not only the fresh feedstock but also the entire effluent from the hydrocracking zone. This patent does not disclose the introduction of the hydrocracking zone effluent directly into the hot, high pressure stripper.

BRIEF SUMMARY OF THE INVENTION

The present invention is a catalytic hydrocracking process wherein a feedstock is introduced into a hydrotreating zone and the resulting effluent therefrom is directly introduced into a hot, high pressure stripper to produce a hot liquid stream which is introduced into a hydrocracking zone and the effluent therefrom is directly introduced into the hot, high pressure stripper. The resulting vapor streams from both the denitrification and desulfurization reaction zones, and the hydrocracking zone is passed upwardly through the hot, high pressure stripper and into a post-treat hydrogenation zone.

Other embodiments of the present invention encompass further details such as types and descriptions of feedstocks, hydrocracking catalysts, denitrification and desulfurization catalysts, hydrogenation catalysts, and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

The process of the present invention is particularly useful for hydrocracking a hydrocarbon oil containing hydrocarbons and/or other organic materials to produce a product containing hydrocarbons and/or other organic materials of lower average boiling point and lower average molecular weight. The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above 288° C. (550° F.), such as atmospheric gas oils, vacuum gas oils, deasphalted, vacuum, and atmospheric residua, hydrotreated or mildly hydrocracked residual oils, coker distillates, straight run distillates, solvent-deasphalted oils, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at temperatures above the end point of the desired product, which end point, in the case of heavy gasoline, is generally in the range from about 193° C. (380° F.) to about 215° C. (420° F.). One of the most preferred gas oil feedstocks will contain hydrocarbon components which boil above 288° C. (550° F.) with best results being achieved with feeds containing at least 25 percent by volume of the components boiling between 315° C. (600° F.) and 538° C. (1000° F.).

Also included are petroleum distillates wherein at least 90 percent of the components boil in the range from about 149° C. (300° F.) to about 426° C. (800° F.). The petroleum distillates may be treated to produce both light gasoline fractions (boiling range, for example, from about 10° C. (50° F.) to about 85° C. (185° F.)) and heavy gasoline fractions (boiling range, for example, from about 85° C. (185° F.) to about 204° C. (400° F.)). The present invention is particularly suited for maximizing the yield of liquid products including middle distillate products.

The selected feedstock is introduced into a denitrification and desulfurization reaction zone at hydrotreating reaction conditions. Preferred denitrification and desulfurization reaction conditions or hydrotreating reaction conditions include a temperature from about 204° C. (400° F.) to about 482° C. (900° F.), a pressure from about 3.5 MPa (500 psig) to about 17.3 MPa (2500 psig), a liquid hourly space velocity of the fresh hydrocarbonaceous feedstock from about 0.1 $hr^{-1}$ to about 10 $hr^{-1}$ with a hydrotreating catalyst or a combination of hydrotreating catalysts.

The terms "denitrification and desulfurization" and "hydrogenation" as used herein refer to processes wherein a hydrogen-containing treat gas is used in the presence of suitable catalysts which are primarily active for the removal of heteroatoms, such as sulfur and nitrogen and for some hydrogenation of aromatics. Suitable "denitrification and desulfurization" and "hydrogenation" catalysts for use in the present invention are any known conventional hydrogenation catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrogenation catalysts include zeolitic catalysts, as well as noble metal catalysts where the noble metal is selected from palladium and platinum. It is within the scope of the present invention that more than one type of hydrogenation catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent.

The resulting effluent from the denitrification and desulfurization reaction zone is transferred without intentional heat-exchange (uncooled) and is introduced into a hot, high pressure stripping zone maintained at essentially the same pressure as the denitrification and desulfurization reaction zone where it is countercurrently stripped with a hydrogen-rich gaseous stream to produce a first gaseous hydrocarbonaceous stream containing hydrocarbonaceous compounds boiling at a temperature less than about 343° C. (650° F.), hydrogen sulfide and ammonia, and a first liquid hydrocarbonaceous stream containing hydrocarbonaceous compounds boiling at a temperature greater than about 343° C. (650° F.). The stripping zone is preferably maintained at a temperature in the range from about 232° C. (450° F.) to about 468° C. (875° F.). The effluent from the denitrification and desulfurization reaction zone is not substantially cooled prior to stripping and would only be lower in temperature due to unavoidable heat loss during transport from the reaction zone to the stripping zone. It is preferred that any cooling of the denitrification and desulfurization reaction zone effluent prior to stripping is less than about 56° C. (100° F.). By maintaining the pressure of the stripping zone at essentially the same pressure as the denitrification and desulfurization reaction zone is meant that any difference in pressure is due to the pressure drop required to flow the effluent stream from the reaction zone to the stripping zone. It is preferred that the pressure drop is less than about 0.8 MPa (100 psig).

At least a portion of the first liquid hydrocarbonaceous stream containing hydrocarbonaceous compounds boiling at a temperature greater than about 343° C. (650° F.) recovered from the stripping zone is introduced directly into a hydrocracking zone along with added hydrogen. The hydrocracking zone may contain one or more beds of the same or different catalyst. In one embodiment, when the preferred products are middle distillates, the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-11}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006 B1.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371°–648° C. (700°–1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 B1 (Klotz).

The hydrocracking of the hydrocarbonaceous feedstock in contact with a hydrocracking catalyst is conducted in the presence of hydrogen and preferably at hydrocracking reactor conditions which include a temperature from about 232° C. (450° F.) to about 468° C. (875° F.), a pressure from about 3.5 MPa (500 psig) to about 20.7 MPa (3000 psig), a liquid hourly space velocity (LHSV) from about 0.1 to about 30 $hr^{-1}$, and a hydrogen circulation rate from about 337 normal $m^3/m^3$ (2000 standard cubic feet per barrel) to about 4200 normal $m^3/m^3$ (25,000 standard cubic feet per barrel). In accordance with the present invention, the term "substantial conversion to lower boiling products" is meant to connote the conversion of at least 5 volume percent of the fresh feedstock. In a preferred embodiment, the per pass conversion in the hydrocracking zone is in the range from about 15% to about 75%. More preferably the per pass conversion is in the range from about 20% to about 60%.

The resulting first gaseous hydrocarbonaceous stream containing hydrocarbonaceous compounds boiling at a temperature less than about 343° C. (650° F.), hydrogen, hydrogen sulfide and ammonia from the stripping zone is introduced into a post-treat hydrogenation reaction zone to hydrogenate at least a portion of the aromatic compounds in order to improve the quality of the middle distillate, particularly the jet fuel. The post-treat hydrogenation reaction zone may be conducted in a downflow, upflow or radial flow mode of operation and may utilize any known hydrogenation catalyst. The effluent from the post-treat hydrogenation reaction zone is preferably cooled to a temperature in the range from about 4.4° C. (40° F.) to about 60° C. (140° F.) and at least partially condensed to produce a second liquid hydrocarbonaceous stream which is divided to produce at least a portion of the hydrogen-rich gaseous stream introduced into the hot, high pressure stripper, the hydrocracking zone and the desulfurization and denitrogenation reaction zone. Fresh make-up hydrogen may be introduced into the process at any suitable and convenient location. Before the hydrogen-rich gaseous stream is divided and introduced into the hydrocracking reaction zone, it is preferred that at least a significant portion, at least about 90 weight percent, for example, of the hydrogen sulfide is removed and recovered by means of known, conventional methods. In a preferred embodiment, the hydrogen-rich gaseous stream introduced into the hydrocracking reaction zone contains less than about 50 wppm hydrogen sulfide.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil is introduced into the process via line 1 and admixed with a hereinafter-described liquid recycle stream transported via line 30. The resulting admixture is transported via line 2 and is admixed with a hydrogen-rich gaseous stream provided via line 22 and the resulting admixture is carried via line 3 and introduced into denitrification and desulfurization zone 4. The resulting effluent from the denitrification and desulfurization zone 4 is carried via line 5 and is admixed with a hereinafter-described effluent from hydrocracking zone 10 carried via line 11 and the resulting admixture is transported via line 6 and introduced into stripping zone 7. A liquid hydrocarbonaceous stream is removed from the bottom of stripping zone 7 via line 8 and is admixed with a hydrogen-rich gaseous stream provided via line 24 and the resulting admixture is carried via line 9 and introduced into hydrocracking zone 10. A resulting hydrocracking effluent is removed from hydrocracking zone 10 via line 11 as hereinabove described. A vaporous stream is stripped and carried upwards in stripping zone 7 and is contacted with hydrogenation zone 31 and a resulting effluent is removed from stripping zone 7 via line 12. The resulting vapor stream contained in line 12 is introduced into heat-exchanger 13 and a partially condensed effluent stream is removed from heat-exchanger 13, carried via line 14 and introduced into high pressure separator 15. A gaseous stream containing hydrogen and hydrogen sulfide is removed from high pressure separator 15 via line 16 and introduced into acid gas recovery zone 17. A lean solvent is introduced via line 18 into acid gas recovery zone 17 and contacts the hydrogen-rich gaseous stream in order to dissolve an acid gas. A rich solvent containing acid gas is removed from acid gas recovery zone 17 via line 19 and recovered. A hydrogen-rich gaseous stream containing a reduced concentration of acid gas is removed from acid gas recovery zone 17 via line 20 and is admixed with fresh make-up hydrogen which is introduced via line 21. The resulting admixture is transported via line 22 and a portion thereof is carried via line 23 to serve as stripping gas in stripping zone 7. Another portion of the hydrogen-rich gaseous stream carried in line 22 is transported via line 24 and is introduced into hydrocracking zone 10 as hereinabove described. The third and remaining portion of the hydrogen-rich gaseous stream carried via line 22 is introduced into denitrification and desulfurization reaction zone 4 as hereinabove described. A liquid stream is removed from high pressure separator 15 via line 25 and is introduced into fractionation zone 26. Light gaseous hydrocarbons and naphtha boiling range compounds are removed from fractionation zone 26 via line 27 and recovered. A liquid stream containing kerosene boiling range compounds is removed from fractionation zone 26 via line 28 and recovered. A liquid hydrocarbon stream containing diesel boiling range compounds is removed from fractionation zone 26 via line 29 and recovered. A heavy liquid hydrocarbon steam containing compounds boiling in the range greater than diesel boiling range compounds is removed from fractionation zone 26 via line 30 and admixed with the fresh hydrocarbonaceous feed as described hereinabove.

ILLUSTRATIVE EMBODIMENT

The process of the present invention is further demonstrated by the following illustrative embodiment. This illustrative embodiment is, however, not presented to unduly limit the process of this invention, but to illustrate the advantage of the hereinabove-described embodiment. All of the following data were not obtained by the actual performance of the present invention but are considered prospective and reasonably illustrative of the expected performance of the invention.

A hydrocracker feedstock in an amount of 100 mass units having the characteristics presented in Table 1 is introduced along with a liquid recycle stream into a denitrification and desulfurization reaction zone at operating conditions presented in Table 2. The resulting effluent from the denitrification and desulfurization reaction zone is combined with the effluent from a hydrocracking zone and introduced into the hot, high pressure stripper operated at a pressure of about 12.2 MPa (1750 psig) and a temperature of about 371° C. (700° F.). A liquid hydrocarbonaceous stream containing hydrocarbons boiling in the range of the fresh feedstock is removed from the bottom of the hot, high pressure stripper and is introduced into the hydrocracking zone at operating conditions presented in Table 2.

TABLE 1

| Hydrocracker Feedstock Analysis Vacuum Gas Oil | |
|---|---|
| Specific Gravity | 0.93 |
| Distillation, Volume Percent | |
| IBP ° C. (° F.) | 222 (432) |
| 5 | 356 (674) |
| 10 | 396 (746) |
| 30 | 429 (806) |
| 50 | 448 (839) |
| 70 | 469 (878) |
| 90 | 502 (937) |
| 95 | 517 (963) |
| Sulfur, weight percent | 2.22 |
| Nitrogen, weight percent | 0.074 |
| (wt. PPM) | (740) |
| Conradson Carbon, weight percent | 0.15 |

TABLE 2

| Summary of Operating Conditions | |
|---|---|
| Denitrification and Desulfurization Reaction Zone | |
| Pressure, MPa (PSIG) | 12.5 (1800) |
| Temperature, ° C. (° F.) | 393 (740) |
| Hydrocracking Reaction Zone | |
| Pressure, MPa (PSIG) | 12.5 (1800) |
| Temperature, ° C. (° F.) | 385 (725) |
| Conversion Per Pass, % | 35 |

The total conversion to hydrocarbons having a boiling point less than 343° C. (650° F.) is 99.5% and a summary of the overall mass balance is presented in Table 3. These results demonstrate the advantages provided by the process of the present invention.

TABLE 3

| Overall Mass Balance | Mass Units |
|---|---|
| Feeds | |
| Vacuum Gas Oil | 100.0 |
| Hydrogen | 2.5 |
| | 102.5 |
| Products | |
| Hydrogen Sulfide | 2.4 |
| Ammonia | 0.1 |
| $C_1$–$C_4$ | 3.0 |
| Naphtha | 14.9 |
| Distillate | 81.9 |
| Unconverted Oil | 0.2 |
| | 102.5 |

The foregoing description, drawing and illustrative embodiment clearly illustrate the advantages encompassed by the process of the present invention and the benefits to be afforded with the use thereof.

What is claimed is:

1. A process for hydrocracking a hydrocarbonaceous feedstock which process comprises:

(a) passing a hydrocarbonaceous feedstock and hydrogen to a denitrification and desulfurization reaction zone at reaction zone conditions including a temperature from about 204° C. (400° F.) to about 482° C. (900° F.), a pressure from about 3.5 MPa (500 psig) to about 17.3 MPa (2500 psig), a liquid hourly space velocity of the hydrocarbonaceous feedstock from about 0.1 hr−1 to about 10 hr−1, with a catalyst, and recovering a denitrification and desulfurization reaction zone effluent therefrom;

(b) passing the denitrification and desulfurization reaction zone effluent to a hot, high pressure stripper utilizing a hot, hydrogen-rich stripping gas to produce a first liquid stream comprising hydrocarbonaceous compounds boiling in the range of the hydrocarbonaceous feedstock and a first vapor stream comprising hydrogen, hydrogen sulfide and ammonia;

(c) passing at least a portion of the first liquid stream comprising hydrocarbonaceous compounds boiling in the range of the hydrocarbonaceous feedstock to a hydrocracking zone containing a hydrocracking catalyst and operating at a temperature from about 204° C. (400° F.) to about 482° C. (900° F.), a pressure from about 3.5 MPa (500 psig) to about 17.3 MPa (2500 psig), a liquid hourly space velocity from about 0.1 hr−1 to about 15 hr−1; and recovering a hydrocracking zone effluent therefrom;

(d) passing the hydrocracking zone effluent directly to the hot, high pressure stripper;

(e) passing at least a portion of the first vapor stream produced in step (b) and at least a portion of the hydrocracking zone effluent to a post-treat hydrogenation reaction zone to saturate aromatic compounds;

(f) condensing at least a portion of a resulting effluent from the post-treat hydrogenation reaction zone to produce a second liquid stream comprising hydrocarbonaceous compounds boiling at a temperature below the boiling range of the hydrocarbonaceous feedstock and a second vapor stream comprising hydrogen and hydrogen sulfide;

(g) recycling at least a first portion of the second vapor stream to the hydrocracking zone;

(h) recycling at least a second portion of the second vapor stream to the denitrification and desulfurization reaction zone;

(i) recycling at least a third portion of the second vapor stream to the hot, high pressure stripper; and (j) recovering the hydrocarbonaceous compounds boiling at a temperature below the boiling range of the hydrocarbonaceous feedstock.

2. The process of claim 1 wherein the second vapor stream comprising hydrogen and hydrogen sulfide is treated to remove at least a portion of the hydrogen sulfide.

3. The process of claim 1 wherein a resulting hydrogen-rich gaseous stream contains less than about 50 wppm hydrogen sulfide.

4. The process of claim 1 wherein the hydrocarbonaceous feedstock boils in the range from about 232° C. (450° F.) to about 565° C. (1050° F.).

5. The process of claim 1 wherein the hot, high pressure stripper is operated at a temperature and pressure which is essentially equal to that of the denitrification and desulfurization reaction zone.

6. The process of claim 1 wherein the hot, high pressure stripper is operated at a temperature no more than about 56° C. (100° F.) below the denitrification and desulfurization reaction zone temperature, and at a pressure no more than about 0.8 MPa (100 psig) below the denitrification and desulfurization zone pressure.

7. The process of claim 1 wherein the hydrocracking zone is operated at a conversion per pass in the range from about 15% to about 75%.

8. The process of claim 1 wherein the hydrocracking zone is operated at a conversion per pass in the range from about 20% to about 60%.

9. The process of claim 1 wherein the denitrification and desulfurization reaction zone contains catalyst comprising nickel and molybdenum.

10. The process of claim 1 wherein the post-treat hydrogenation reaction zone is operated at reaction zone conditions including a temperature from about 204° C. (400° F.) to about 482° C. (900° F.) and a pressure from about 3.5 MPa (500 psig) to about 17.3 MPa (2500 psig).

11. A process for hydrocracking a hydrocarbonaceous feedstock which process comprises:

(a) passing a hydrocarbonaceous feedstock boiling in the range from about 232° C. (450° F.) to about 565° C. (1050° F.) and hydrogen to a denitrification and desulfurization reaction zone at reaction zone conditions including a temperature from about 204° C. (400° F.) to about 482° C. (900° F.), a pressure from about 3.5 MPa (500 psig) to about 17.3 MPa (2500 psig), a liquid hourly space velocity of the hydrocarbonaceous feedstock from about 0.1 hr−1 to about 10 hr−1 with a catalyst, and recovering a denitrification and desulfurization reaction zone effluent therefrom;

(b) passing the denitrification and desulfurization reaction zone effluent to a hot, high pressure stripper operated at a temperature no more than about 56° C. (100° F.) below the denitrification and desulfurization zone temperature and at a pressure no more than about 0.8 MPa (100 psig) below the denitrification ad desulfurization zone pressure, utilizing a hot, hydrogen-rich stripping gas to produce a first liquid stream comprising hydrocarbonaceous compounds boiling in the range of the hydrocarbonaceous feedstock and a first vapor stream comprising hydrogen, hydrogen sulfide and ammonia;

(c) passing at least a portion of the first liquid stream comprising hydrocarbonaceous compounds boiling in the range of the hydrocarbonaceous feedstock to a hydrocracking zone containing a hydrocracking catalyst and operating at a temperature from about 204° C. (400° F.) to about 482° C. (900° F.), a pressure from about 3.5 MPa (500 psig) to about 17.3 MPa (2500 psig), a liquid hourly space velocity from about 0.1 hr−1 to about 15 hr−1; and recovering a hydrocracking zone effluent therefrom;

(d) passing the hydrocracking zone effluent directly to the hot, high pressure stripper;

(e) passing at least a portion of the first vapor stream produced in step (b) and at least a portion of the hydrocracking zone effluent to a post-treat hydrogenation reaction zone to saturate aromatic compounds;

(f) condensing at least a portion of a resulting effluent from the post-treat hydrogenation reaction zones to produce a second liquid stream comprising hydrocarbonaceous compounds boiling at a temperature below the boiling range of the hydrocarbonaceous feedstock and a second vapor stream comprising hydrogen and hydrogen sulfide;

(g) recycling at least a first portion of the second vapor stream to the hydrocracking zone;

(h) recycling at least a second portion of the second vapor stream to the denitrification and desulfurization reaction zone;

(i) recycling at least a third portion of the second vapor stream to the hot, high pressure stripper; and (j) recovering the hydrocarbonaceous compounds boiling at a temperature below the boiling range of the hydrocarbonaceous feedstock.

* * * * *